US010151066B2

(12) United States Patent
Bindernagel et al.

(10) Patent No.: US 10,151,066 B2
(45) Date of Patent: Dec. 11, 2018

(54) RACK CHANGE SYSTEM, CHANGE CARRIAGE, AND SWITCH FOR A RACK CHANGE SYSTEM AND ROLLING MILL WITH A ROLLING BLOCK AND A RACK CHANGE SYSTEM

(71) Applicant: KOCKS Technik GmbH & Co. KG, Hilden (DE)

(72) Inventors: Ali Bindernagel, Solingen (DE); Ralf Dedeken, Wiehl (DE)

(73) Assignee: KOCKS Technik GmbH & Co. KG, Hilden (DE)

( * ) Notice: Subject to any disclaimer, the term of this patent is extended or adjusted under 35 U.S.C. 154(b) by 293 days.

(21) Appl. No.: 14/885,364

(22) Filed: Oct. 16, 2015

(65) Prior Publication Data

US 2016/0168803 A1 Jun. 16, 2016

(30) Foreign Application Priority Data

Oct. 31, 2014 (DE) ..... 10 2014 015 963

(51) Int. Cl.
*E01B 7/00* (2006.01)
*B21B 31/10* (2006.01)

(52) U.S. Cl.
CPC ..... *E01B 7/00* (2013.01); *B21B 31/10* (2013.01)

(58) Field of Classification Search
CPC ..... E01B 7/00; B21B 31/10
See application file for complete search history.

(56) References Cited

U.S. PATENT DOCUMENTS 3,306,090 A * 2/1967 Meurer ..... B21B 17/14 72/239
3,418,838 A * 12/1968 Rotert ..... B21B 17/14 72/239
6,253,593 B1 * 7/2001 Goto ..... B21B 19/04 72/238
8,910,869 B2 * 12/2014 Schutzmann ..... G07D 7/04 235/449

(Continued)

FOREIGN PATENT DOCUMENTS

CN 1091061 A 8/1994
CN 2829928 Y 10/2006

(Continued)

OTHER PUBLICATIONS

International Search Report dated Apr. 17, 2014 from Internation Application No. PCT/EP2013/003923.

(Continued)

*Primary Examiner* — Jason C Smith
(74) *Attorney, Agent, or Firm* — Howard IP Law Group

(57) ABSTRACT

The present invention relates to a rack change system for changing of roller racks of a rolling block with a rail system along which change carriages can be moved, wherein the rail system includes a first track and a second track, which extend in different directions and are connected to one another via a switch, wherein the first track runs parallel to the rolling line of the rolling block, wherein a roller rack can be moved from the rolling block to the change carriage or a roller rack can be moved from the change carriage to the rolling block when the change carriage is standing on the first track and/or on the switch.

17 Claims, 5 Drawing Sheets

(56) References Cited

U.S. PATENT DOCUMENTS

2016/0168803 A1* 6/2016 Bindernagel ..... B21B 31/10
104/130.01

FOREIGN PATENT DOCUMENTS

| | | | |
|---|---|---|---|
| CN | 201040288 | Y | 3/2008 |
| CN | 201978942 | U | 9/2011 |
| DE | 1240022 | B | 5/1967 |
| DE | 1527659 | A1 | 3/1970 |
| DE | 2611703 | A1 | 9/1977 |
| DE | 2611703 | B2 | 3/1978 |
| DE | 2834287 | A1 | 2/1980 |
| DE | 69835455 | T2 | 8/2007 |
| DE | 102011106263 | A1 | 12/2011 |
| DE | 102010035469 | A1 | 3/2015 |
| EP | 0184218 | A2 | 6/1986 |
| GB | 1558428 | | 1/1980 |
| GB | 1558428 | A | 1/1980 |
| JP | 61189603 | A | 8/1986 |
| WO | 98/38792 | A1 | 9/1998 |

OTHER PUBLICATIONS

Written Opinion dated Apr. 17, 2014 from International Application No. PCT/EP2013/003923.
International Preliminary Report on Patentability dated Jul. 7, 2015 from International Application No. PCT/EP2013/003923.

* cited by examiner

RACK CHANGE SYSTEM, CHANGE CARRIAGE, AND SWITCH FOR A RACK CHANGE SYSTEM AND ROLLING MILL WITH A ROLLING BLOCK AND A RACK CHANGE SYSTEM

CROSS-REFERENCE TO RELATED APPLICATIONS

This application claims the benefit of priority under 35 U.S.C. § 119(a) to German Patent Application No. 10 2014 015 963.9 filed Oct. 31, 2014, which is incorporated herein by reference in its entirety for all purposes.

FIELD OF THE INVENTION

The present invention relates to a rack change system for changing of roller racks of a rolling block and to a change carriage and a switch for such a rack change system. Furthermore, the present invention relates to a rolling mill with a rolling block and such a rack change system and method for changing roller racks.

BACKGROUND OF THE INVENTION

From practice, essentially two variants of rack change systems for switching of roller racks of a rolling block are known. Such rack change systems are based on change carriages for receiving the roller racks. Typically, at least two independently movable carriages are used. However, embodiments are also known in which only one carriage or two rigidly connected carriages are used.

The first variant of a rack change system (I type) known from practice is characterized in that a rail track for the change carriage is arranged parallel to the rolling line in front of the rolling block. The one change carriage serves for receiving prepared new roller racks and the second change carriage serves for receiving roller racks present in the rolling block. During the roller rack change process, the rolling block drives are stopped and a protective hood is opened and the couplings in the rolling block are separated so that the roller racks can be pushed onto the waiting, empty rack change carriage, using a suitable device on the rolling block. Subsequently, both change carriages move in the direction of the rolling line so that the change carriage with the new roller racks stops in front of the rolling block and the roller racks can be pushed into the rolling block again, using a suitable device. After coupling the roller rack and closing the protective hood, the rolling operation can be resumed. Embodiments are known from practice in which this process typically takes between 3 and 5 minutes.

After the change process has been completed and the rolling operation has been resumed, the change carriage can be unloaded by a crane and the changed roller racks can be transported to the rack workshop. Likewise, the empty change carriage can again be loaded with newly prepared roller racks by a crane, the roller racks having been transported from the roller workshop.

The advantage of this variant lies in the short travel time of the change carriage in front of the rolling block and the associated short rack change time. The disadvantage is the involved and time-consuming loading and unloading of the change carriage by means of a hall crane in the mill as well as the non-automated transport of the roller racks to and from the rolling block in the roller workshop.

In this variant, the change carriages can only be moved independently of each other if they are each equipped with their own drive. This can be, for example, an electrically operated drive for the wheels. To this end, the change carriage has to be coupled with a power supply, which is generally implemented by means of a drag chain. Thus, the possible travel path of the change carriage is significantly limited. A more favorable cable system, the drive of which is arranged stationary in the hall floor, can be present only once on a travel path, however, so that, in one embodiment of the variant with the cable system described above, both change carriages must be firmly coupled to each other or, alternatively, a suitably large change carriages must be used that can accommodate both, the used as well as the new, prepared roller racks.

In the second variant known from practice, a track of a rail system is provided that extends transversely to the rolling line and in the direction of the roller block. Set at a certain distance from the rolling block, a rotary switch is provided. Via the rotary switch, another track is connected to the track arranged transverse to the rolling line. This additional track, arranged at a right angle to the main direction of travel, allows for a parking or waiting position for a change carriage. This second variant (T type) requires that at least two independently movable change carriages are available.

During the rack change in the second variant, an empty change carriage is provided at the end of the track transverse to the rolling line. After stopping the rolling block drives, opening the protective hood, and uncoupling the racks, the racks are pushed onto the empty change carriage, waiting in front of the block. Once this process is completed, the change carriage travels to the position of the rotary switch and stops there. Then the four wheels of the change carriage are rotated 90° by means of the rotary switch and the carriage can be moved to the park position by means of a second cable system. Once the change carriage has arrived there, the rotary switch can again be rotated 90° and the second carriage waiting behind the switch with the new racks can be coupled into the first cable system and driven in front of the rolling block. Once the second change carriage has arrived there, the prepared roller racks are pushed into the roller block, the racks are coupled in, the hood is closed, and the rolling operation can continue. Subsequently, the rotary switch is rotated again by 90° so that the change carriage parked by means of the second cable system can leave the park position again and moves onto the rotary switch. Once it has returned to this position, after another actuation of the rotary switch, it can be driven into the roller workshop over the track transverse to the rolling line where it can be unloaded and be loaded again with new prepared roller racks. Subsequently, the prepared change carriage moves back to the waiting position behind the rotary switch (viewed from the rolling block).

The advantage of the second variant (T type) over the first variant (I type) of the rack change system is the possibility of driving the change carriage directly into the roller workshop. This avoids the cumbersome reloading of the racks onto another transportation system. However, a disadvantage of this variant is the significantly longer rack change time, which, due to the additional multiple switching of the switch and the additional transverse drive of the change carriage, results in a rack change time lasting 2 to 3 minutes longer, and therefore a longer break in production of the entire mill.

The rack change system of the second variant (T type) allows for the use of a stationary drive system of the change carriage (for example, a cable system). Thereby, a separate system must be provided for each driving direction. This makes it possible to implement travel paths of any length since the rack change carriage does not require its own on-board drive system, and therefore no separate power supply.

For the efficient operation of pipe, profile, rod, and wire mills, minimizing the rack change times is of significant importance. Due to increasingly smaller batch sizes and frequent dimensional changes in production, replacement of the roller racks is required in ever shorter intervals. Each rack change results in a break in production, which reduces the total output of the mill. For this reason, the rack change times are of crucial importance for the productivity of the rolling mill.

SUMMARY

Against this background, the object of the invention is to propose a rack change system for changing of roller racks of a rolling block that avoids the reloading process for the roller racks by means of a crane, but at the same time reduces the rack change time.

This object is achieved by the subject matter of the independent claims. Advantageous embodiments are presented in the dependent claims and the description following hereafter.

The basic idea of the invention can be seen in that the switch and/or the track of the rail system of the second variant (T type) described above, which provides the park or the waiting position, is moved close to the roller rack such that a roller rack can be moved from the rolling block onto the change carriage or a roller rack can be moved from the change carriage into the rolling block when the change carriage is standing on this same track and/or the switch. In the rack change system according to the invention, therefore, at least the times can be saved during which the initially empty change car is moved from the receiving position over the switch into the park or holding position after receiving the roller racks to be replaced. With the rack change system according to the invention, it is possible to have a change carriage loaded with new roller racks standing on the first track while an empty change carriage is standing on the switch. For a rack change, the roller racks to be changed can then be moved onto the empty change carriage standing on the switch. The loaded change carriage can then be moved from the switch via the second track. Meanwhile, the change carriage, loaded with the new roller racks to be fed in and standing on the first track, can be moved onto the switch and the roller racks loaded on it can be fed into the rolling block.

In one preferred embodiment, the rack change system according to the invention is equipped with a third track of the rail system has, extending in at least one direction different from the second track and which is connected with the first track and/or the second track via a switch. In preparation for a subsequent rack change after a completed rack change, it is necessary to move the change carriage, which is empty after the completed rack change and standing in the transfer position and from which, during the previous rack change, the racks were moved into the rolling block, to an intermediate position so that a change carriage loaded with new roller racks can be moved into a position from where it can be moved quickly to a transfer position.

In one preferred embodiment, the third track is aligned with the first track and is positioned on the opposite side of the switch with respect to the first track. Such an embodiment allows for a rack change comprising the steps of: The rack change is prepared by the change carriage loaded with new roller racks standing on the first track and an empty change carriage standing on the switch. The roller racks to be changed are then moved out of the rolling block and onto the empty change carriage standing on the switch. Then, the change carriage loaded with the removed roller racks and the change carriage loaded with the new roller racks are moved together linearly, so that the change carriage loaded with the removed roller racks is now standing on the third track and the change carriage loaded with the new roller racks to be fed in is standing on the switch. From here, the new roller racks to be fed in are moved into the rolling block.

Such an approach minimizes the rack change time because, between the removal of the roller racks to be replaced and the introduction of new roller racks to be fed in, only a linear moving of the change carriage is performed. It does not even require the time for turning the switch, since the first and the third track are arranged in alignment and thus permit a linear movement of the two carriages. While, after the introduction of new roller racks to be fed in, the rolling operation is resumed, the change carriages are prepared for the next roller change. To this end, the now empty change carriage, standing on the switch, can be moved back to the first track and the change carriage loaded with the changed roller racks can be moved from the third track to the switch. After turning the switch, the change carriage loaded with the changed roller racks can be moved along the second track into the roller workshop, where it can be loaded with new roller racks. Subsequently, it is moved to the switch along the second track. After turning the switch again, the change carriage loaded with the new roller racks is pushed onto the third track, while the currently empty change carriage is pushed from the first track onto the switch to be ready for the removal of the roller racks to be subsequently changed.

The embodiment described above with a third track of the rail system is based on the fundamental idea that the transport of roller racks by change carriage is divided into a first phase and a second phase. In the first phase, the roller racks are preferably moved only parallel to the rolling line. In the second phase, the roller racks can be moved by the change carriage parallel to the rolling line on the first and third track, but also transversely to the rolling line on the second track.

In this preferred embodiment, the actual rack change process can take place during the first phase. After completion of the first phase, the production of the rolling mill can be resumed and all subsequent actions of the rack change will no longer affect the productivity of the rolling mill.

In one preferred embodiment, the total length of the first track, the switch, and the third track largely corresponds to the length of three roller carriages. With such dimensioning, the space that the rack change system occupies in front of the rolling line can be reduced. As described above, the rack change system, however, can also be implemented such that only the first track and a switch are provided in front of the rolling block. As a result, the space provided for the rack change system in front of the rolling block can be reduced significantly. For such an embodiment, the third track is then provided at a different location.

In one embodiment, the first track is connected to the second track via a switch and the third track is connected to the second track via a second switch. For example, the second switch and the third track may be provided in the rack change workshop. Above, a method for performing a rack change has been described, in which an empty change carriage is standing on the switch and a change carriage loaded with new roller racks to be fed in is standing on the first track, whereby, after receiving the roller racks, the initially empty change carriage with the now loaded roller racks is moved along the second track away from the switch and, after turning the switch, the change carriage loaded with the new roller racks is pushed onto the switch in order from there to then feed the new roller racks to be fed in into the rolling block. To prepare the rack change system for the next roller change from this situation, a change carriage loaded with newly loaded roller racks must be moved onto the first track, past the empty change carriage still standing on the switch. This can be achieved by moving the empty change carriage, standing on the switch, along the second track to a second switch and moving it to a third track into a park position after turning the switch. Subsequently, the change carriage loaded with new roller racks is moved via the second track to the first switch, and from there to the first track. Then, the empty change carriage can be placed onto the switch via the second switch and the second track to be ready there for receiving the roller racks then to be changed. The third track and a second switch then to be provided can be located at any place between the first switch and the rack change workshop that least interferes with the construction of the mill, optionally even in the rack change workshop.

The foregoing shows that the invention does not necessarily need to be implemented with a third track, which must be aligned with the first track and be located on the opposite side of the same switch with respect to the first track. It should be expected, however, that in the preferred embodiment, in which the third track is aligned with the first track and located on the other side of the switch, particularly fast rack change times can be achieved and and a minimum of movements of change carriers is required to be performed. Furthermore, with this particularly preferred embodiment, a second switch may be omitted.

In one preferred embodiment, the switch is a rotary switch with a number of rotary bodies that corresponds to the number of wheel sets of the change carriage, wherein one rotating body can accommodate one wheel set of a change carriage and, by rotation of the rotating body, the wheel set, which is rotatably mounted to the change carriage, can be pivoted from a first orientation to a second orientation. With such a rotary switch, therefore, only the orientation of the wheel sets of the change carriage is changed, while the orientation of the change carriage remains unchanged. This has particular advantages with regard to the applied forces or torques, as it should be expected that the pivoting of a wheel set, rotatably mounted to the change carriage, from a first orientation to a second orientation can be carried out with lower forces or torques than the changing of the overall orientation of the change carriage—also conceivable in an alternative embodiment—for example, on a railed turntable, on the rails of which the change carriage stands and wherein, through rotation of the plate, the entire change carriage is changed in its orientation.

In one preferred embodiment, the first orientation direction of the axles of the change carriage differs by 90° from the second orientation direction of the wheel set.

In one preferred embodiment, a drive system for the change carriage is provided, which can move a change carriage along the first track and, independently thereof, can move the change carriage along the second track. For such purpose, cable systems are particularly preferably used, the drive of which can be located in the hall floor of a rolling mill with such a rack change system.

In one preferred embodiment, the drive system is formed by two independent cable systems, wherein the change carriage can be moved along the first track by the first cable system and, independently thereof, the change carriage can be moved along the second track by the second cable system.

In one preferred embodiment, at least in one of the rails of one of the tracks, a recess for accommodating a wheel set of a change carriage is provided. The recess can serve to keep a change carriage in this position while another change carriage, coupled with this change carriage, is decoupled from this change carriage and moved away from this change carriage. Particularly preferably, such a receiving element is provided in the first and/or in the third track (if present).

In one preferred embodiment, the recesses are arranged such that the respective rear wheel set (the wheel set distant from the switch) of the change carriage moves into the recess and thus a passage through the recess is not required. The passage over the recess can be prevented by the recess having a shallow entrance and exit slope of, for example, approx. 2° and, on the opposite side, a steep ramp of, for example, 10° is provided. The recesses are designed such that, on one hand, the drive system of the change carriage is capable of moving the change carriage out of the recess with the least possible force, but, on the other hand, the non-driven change carriage can be held in its waiting position.

The rack change system according to the invention has a rail system. Particular preferably, the rails of the rail system are embedded in the floor of the mill. Embodiments are also conceivable in which the rails are positioned on the floor of the mill, whereby costs for laying the rails can be saved. For operational safety reasons, however, it is recommended not to arrange the rails to be protruding from the floor of the mill, but to integrate them into the floor of the mill, as in this manner the operators of the mill cannot as easily trip over the rails.

In one preferred embodiment, the first track extends in a direction which is 90° to the direction in which the second track extends. As a result, a change carriage located on the first track and near the switch can, in particular, be prevented from colliding with a change carriage moving along the second track, for example, onto the switch. However, embodiments are also conceivable in which the first track extends at a different angle from the second track. Furthermore, embodiments are conceivable, in which, immediately following the switch, the second track, after initially extending in a first direction, extends in another direction, which can also run parallel to the first track. The course of the second track at a greater distance from the switch depends in particular on the arrangement of the rack change workshop relative to the rolling block. Therefore, embodiments also form part of the invention in which the second track, after initially extending in a direction different from the first track, extends in a plurality of directions, the example, first in an arc and then straight again or the like.

In one preferred embodiment, a change carriage has four wheel sets, whereby each wheel set has one wheel. However, change carriages with six, eight, or more wheel sets are also conceivable, especially also for larger weights or a higher number of roller racks to be loaded simultaneously.

In one preferred embodiment, the rack change system according to the invention has a device with which a roller rack can be moved from the roller block onto the change carriage and/or with which a roller rack can be moved from the change carriage into the rolling block. Such a device may include, for example, a push bar or a pull bar, but also a chain system with a chain attached to the chain carrier.

In one preferred embodiment, the change carriage has locking elements. These may be, for example, lowerable stamps, which can be provided on one or more of the edges of the change carriage and which can be lowered for locking the change carriage. The locking elements of the change carriage serve to at least partially absorb the forces created during the movement of the rolling rack from the rolling block onto the change carriage or during the movement of a rolling rack from the change carriage into the rolling block and to prevent the change carriage from moving out of the receiving position.

A change carriage according to the invention for a rack change system according to the invention has a receiving element for a coupling hook of another change carriage and a receiving recess, opening into the receiving element, through which a coupling hook can be pushed into the receiving element along an insertion direction. Adjacent to the receiving element, a stop is provided for transferring longitudinal forces from the stop onto the coupling hook and/or for transferring longitudinal forces from the coupling hook onto the stop, wherein the stop has a stop surface, the surface normal of which points at an angle to the insertion direction. Particularly preferably, the surface normal of the stop surface is at an angle of 90° to the insertion direction.

In the particularly preferred embodiment, in which a third track of the rail system is provided and is aligned with the first track and on the opposite side of the switch with respect to the first track, the drive system for the change carriage can be designed such that it can pull or push a change carriage, for example, through use of a cable system that has a hook that can be engaged with a change carriage. In such an embodiment, it is preferred that the change carriages can be coupled to each other. As a result, a first change carriage driven by the drive system can move a second change carriage, coupled to it, also in the direction of movement. The direction of movement is typically parallel to the rolling direction of the roller rack. After the change carriages that are coupled to one another have been moved in the direction of movement, it may be provided that one of the two change carriages is to be moved by the drive system in a different direction of movement while the other change carriage is to remain stationary. The provision of an insertion recess, opening into the receiving element for the coupling hooks, makes it possible in this case to move the one change carriage away from the other change carriage, namely opposite to the insertion direction. One coupling hook is thus removed from the receiving element through the insertion recess. In order to couple the carriages to one another, the one change carriage with its coupling hook can be moved in the direction of the insertion direction so that the coupling hook is inserted through the insertion recess and into the receiving element. In the receiving element, the coupling hook can then engage with the stop adjacent to the receiving element so that longitudinal forces can be transferred from the stop onto the coupling hook, for example, when the change carriage provided with the receiving element is moved and pulls behind it the change carriage provided with the coupling hook, or longitudinal forces can be transferred from the coupling hooks onto the stop when the change carriage provided with the coupling to hook is moved and pulls behind it or pushes the change carriage provided with the receiving element.

In one preferred embodiment, a change carriage has a coupling hook on a first side and, on the opposite side, a receiving element for a coupling hook of another change carriage. However, embodiments are also possible, in which a change carriage has only a coupling hook on one side, but no receiving element on the other side, while another change carriage has only a receiving element on one side, but no coupling hook.

The coupling hook is designed as a projection, in particular a projection facing downwards or upwards from a projecting element. Therein, the projection may be pin-shaped. However, it is especially preferred that it has a rectangular cross-section, as this is particularly suited for transferring longitudinal forces onto a stop surface. In particular, the coupling hook with a rectangular cross-section of the projection can have a threading slopes, tapering outwards on the sides in the insertion direction and opposite the insertion direction, and can also enable insertion of the coupling hook in the insertion direction when the coupling hook and the insertion recess are not perfectly aligned to one another.

The protruding piece of the coupling hook is particularly preferably pivotally connected to the change carriage. This may serve for better insertion of the coupling hook into the receiving element when the change carriages are standing in a line and the coupling hook is not to be inserted into the receiving element through the insertion recess.

In one preferred embodiment, a coupling hook pivotally mounted on the change carriage has a path delimiter, on which the coupling hook rests and which limits the pivoting movement of the coupling hook caused by gravity.

In one preferred embodiment, a handle is provided on the coupling hook, with which the coupling hook can be easily pivoted around the pivot axis.

In one preferred embodiment, the insertion recess has a ramp-shaped base, which slopes upward toward the receiving element. Additionally or alternatively, the walls circumscribing the insertion recesses laterally can extend at an angle with respect to the insertion direction to the receiving element so that the insertion recess tapers in the direction of the receiving element. These lateral threading slopes facilitate the insertion of the coupling hook into the receiving element when the one change carriage is moved in the insertion direction for the purpose of coupling it to the other change carriage.

In one preferred embodiment, the change carriage also has an insertion ramp through which a coupling hook can be inserted into the receiving element, wherein the stop surface is adjacent to the surface of the insertion ramp. This facilitates the insertion of the coupling hook into the receiving element when the change carriages are moved with respect to each other in the longitudinal direction, and the coupling hook is thus inserted not into the receiving element through a laterally arranged insertion recess, but through a frontally arranged insertion ramp.

In one preferred embodiment, the rack change system according to the invention includes at least one change carriage according to the invention. In a particularly preferred embodiment, the rack change system according to the invention includes a change carriage according to the invention and a change carriage with a coupling hook. In a particularly preferred embodiment, the rack change system according to the invention includes two change carriages according to the invention, wherein at least one of the two change carriages according to the invention, particularly preferably both change carriages according to the invention, in addition to the receiving element for a coupling hook of the other change carriage, each include a coupling hook that can be inserted into the receiving element of the other change carriage.

The rolling mill according to the invention includes a rolling block and a rack change system according to the invention. The rack change system according to the invention is arranged such that a roller rack can be moved from the rolling block onto the change carriage or a roller rack can be moved from the change carriage into the rolling block when the change carriage is standing on the first track and/or the switch. Particularly preferably, the rolling block includes two, three, four, or more, preferably more than four, exchangeable roller racks.

In one preferred embodiment, the rolling mill according to the invention includes a roller workshop, wherein the second track preferably runs from the switch to the roller workshop.

In one embodiment of the method according to the invention for changing the roller racks of a rolling block by means of a rack change system with a rail system, having a first track and a second track, extending in different directions and connected to one another via a switch, wherein the first track extends parallel to the rolling line of the rolling block, the following process steps are provided:

- A first, empty change carriage is standing on the switch and a second change carriage, loaded with at least one new roller rack to be fed into the rolling block, is standing on the first track;
- A roller rack is moved from the rolling block onto the first change carriage;
- The first change carriage is moved onto the second track;
- The second change carriage is moved from the first track onto the switch and the new roller rack is moved from the second change carriage into the rolling block.

In one preferred embodiment, the first change carriage is moved along the second track into a roller workshop.

In a second embodiment of the method according to the invention for changing roller racks of a rolling block by means of a roller rack change system, including a rail system having a first track and a second track, each extending in different directions and being connected via a switch, and having a third track aligned with the first track, wherein the first track extends parallel to the rolling line of the rolling block, the following process steps are provided:

- A first, empty change carriage is standing on the switch and a second change carriage, loaded with at least one new roller rack to be fed into the rolling block, is standing on the first track;
- A roller rack is moved from the rolling block onto the first change carriage;
- The first change carriage is moved onto the third track;
- The second change carriage is moved from the first track onto the switch and the new roller rack is moved from the second change carriage into the rolling block.

In one preferred embodiment, after the transfer of the roller rack to the rolling block, the second change carriage is moved onto the first track and the first change carriage is moved from the third track onto the switch, from the switch onto the second track, and via second track into a roller workshop.

In one preferred embodiment, the first and second change carriages are always moved together while coupled together if they are to be moved in the same direction in successive process steps, for example, if the second change carriage is to be moved onto the third track after receiving the roller racks and the first change carriage is to be moved onto the switch with the new roller racks to be fed in.

In one preferred embodiment, the first change carriage in the rack workshop is loaded with a new roller rack to be fed into the rolling block and moved along the second track onto the switch, and from the switch onto the third track.

In one preferred embodiment, the second change carriage is moved from the first track onto the switch, along with the movement of the first change carriage from the switch onto the third track.

As can be seen from the above description, the arrangement of the new roller racks to be fed into the rolling block preferably changes with each cycle. This allows for the advantages of the invention to be particularly well applied and unnecessary travel paths of the change carriages to be avoided. If, in a first cycle, the change carriage loaded with new roller racks to be fed into the rolling block is placed on the first track, it is clear from the above sequence of travel paths of the change carriages that, in the next cycle, the change carriage loaded with new roller racks to be fed into the rolling block is placed onto the third track. This results in an alternation from one cycle to another of the use of the first track and the third track as the respective starting point of the change carriage loaded with new roller racks to be fed into the rolling block at the start of the rack change to be performed.

The switch according to the invention for a rack change system includes at least one rotating body for receiving a wheel set of a change carriage. The rotating body is rotatable in order to pivot the wheel set, mounted pivotably to the change carriage, from a first orientation direction to a second orientation direction. The switch according to the invention is suitable for a rack change system for changing roller racks of a rolling block, including a rail system, along which the change carriage can be moved, wherein the rail system includes at least a first track and a second track, which can be connected to one another via the switch according to the invention. Particularly preferably, the switch according to the invention is used as an assembly of the rack change system according to the invention. The switch according to the invention is characterized in that the rotary body includes two intersecting tracks that are each configured such that a wheel set of a change carriage can move into them.

Conventional switches for rack change systems typically include rotating bodies, which have only one straight track straight track along the rotating body. In such embodiments of the rotary body, it may be necessary, depending on the operating situation of the rack change system, to pivot by 90° the rotating body provided with only one track, in order to accommodate a change carriage. In the T type variant described above, an operating situation occurs in which the change carriage, which has received the roller racks just removed from the rolling block, is driven from the rolling block via a switch into the roller workshop, while on a secondary track, which is also connected to the switch, the change carriage loaded with new roller racks awaits its use. Once the change carriage loaded with old roller racks passes the switch, the rotating bodies of this switch are aligned such that their (only) track is not aligned with the rails of the secondary track. The rotating body of a thus configured switch must therefore be rotated 90° in an empty run before the change carriage loaded with new roller racks can be moved onto the switch. Thereafter, the rotating bodies are again rotated by 90° to align the track with the rails of the track leading to the rolling block. If the rotating bodies of the change switch according to the invention are formed with two intersecting tracks that are each configured such that a wheel set of a change carriage can move into them, the empty run described above can be avoided. The change carriage traveling from the rolling block to the workshop passes the switch by its wheel sets driving through the one track. The change carriage waiting on the secondary line can move into the switch—without the rotating bodies needing to be rotated—by its wheel sets driving into their respectively assigned second track, which crosses the first track. Only then must the rotating body be pivoted in order to align the wheel sets of the change carriage moving from the secondary track to the switch with the rails of the track leading to the rolling block.

In one preferred embodiment of the switch according to the invention, all rotating bodies are formed with two intersecting rails. This is useful in order to be able to perform the movements of the rotating bodies synchronously.

In one preferred embodiment, the rails of the rotating body intersect at an angle of 90°. The intersection angle of the rails is dependent on the angle of the respective track connected to the switch with respect to the respective other track connected to the switch. The advantages of the invention can be achieved particularly well if the tracks adjacent to the switch each extend at an angle of 90° to one another, and the angle at which the tracks of the rotating bodies intersect is therefore also 90°.

In one preferred embodiment, at least one, particularly preferably each, track of a rotary body is trough-shaped. This is understood to mean that the track is sloped downward toward the center of the rotating body and is sloped upward toward the respective edges of the rotating body. The trough can ensure that during pivoting of the rotating body, the wheel of the wheel set of the change carriage, which is moved into the track, remains in its position.

In one preferred embodiment, the respective track of the rotating body extends from one edge of the rotating body to another, such that a change carriage can cross the switch without the need to pivot the rotating body when two tracks are aligned and connected via a switch.

The rack according to the invention change system as well as the change carriage according to the invention and the rolling mill according to the invention are particularly preferably used for rolling pipes, for rolling profiles, for rolling rods, or for rolling wire.

BRIEF DESCRIPTION OF THE DRAWINGS

In the following, the invention will be described in more detail with reference to a drawing, merely illustrating embodiments. In the figures.

DETAILED DESCRIPTION

Figure 1:
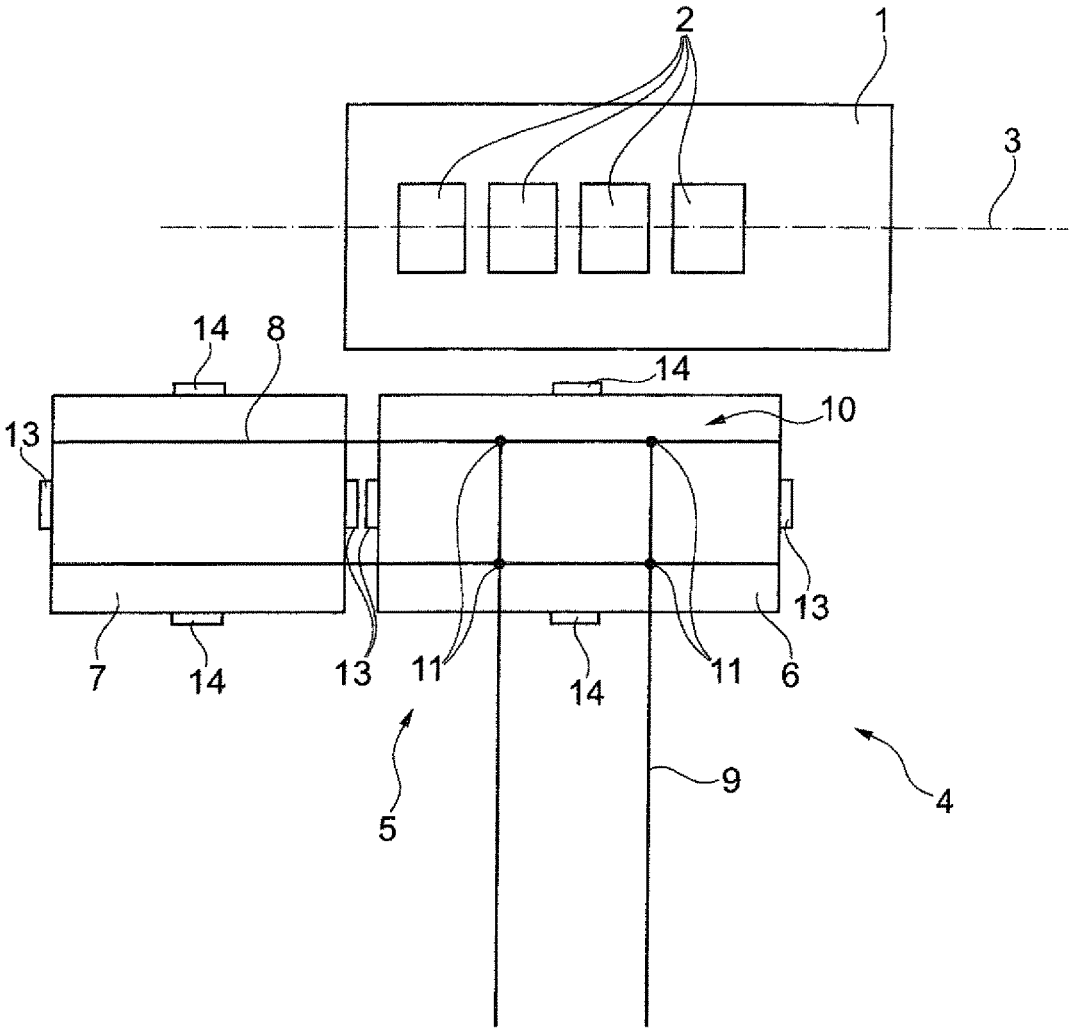
FIG. 1 shows a schematic top view of parts of a rolling mill according to the invention.

Shown are a rolling block 1 with four roller racks 2 replaceably arranged in the rolling block 1. The roller racks 2 are arranged such that they can roll rolling goods, such as pipes, profiles, rods, or wire, along the rolling line 3.

The rack change system 4 according to the invention for changing the roller racks 2 of the rolling block 1 includes a rail system 5, along which the change carriages 6, 7 can be moved. In the embodiment shown in FIG. 1, the rail system includes a first track 8 and a second track 9. The first track 8 extends in a direction that that differs by 90° from the direction in which the second track 9 extends. The first track 8 and the second track 9 are connected to one another via a switch 10. The first track 8 extends parallel to the rolling line 3 of the rolling block 1.

In the embodiment shown in FIG. 1, the roller racks 2 can be moved from the rolling block 1 onto the change carriage 6, standing on the switch 10, by rack changing devices not shown in the figure. Similarly, in an alternative operating situation of FIG. 1, roller racks loaded on the change carriage 6 could be moved into the rolling block 1 by the changing device when a change carriage is standing on the switch.

The switch is designed as a rotary switch. It includes four rotating bodies 11. The change carriage 6 as well as the change carriage 7 (not shown) include four wheel sets, whereby each wheel is mounted rotatably around its vertical axis on the change carriage. The rotating bodies 11 of the switch 10 can each accommodate one wheel set of a change carriage. By rotation of the respective rotary body 11, the respective wheel set of the change carriage accommodated by it can be pivoted from a first orientation direction, for example an orientation in which the wheels are aligned in the direction of the first track 8, to a second orientation direction, for example by 90°, so that the wheel sets are oriented in the direction of the second track 9.

The change carriage 6 and the change carriage 7 of the embodiment according to FIG. 1 are not coupled together. On the front and back of the respective change carriage 6, 7, hollow pawls 13 are provided. A fastening element of a cable system, not shown, of a drive system for the change carriages can be inserted in such a hollow pawl. Using this first cable system (not shown), which is coupled with a hollow pawl 13, a change carriage, standing on the first track 8, can be pulled onto the switch 10 or, when using the opposite hollow pawl of the respective change carriage, can be pulled from the switch 10 onto the first track 8. Furthermore, the change carriages 6 and 7 each include laterally arranged hollow pawls 14. These laterally arranged hollow pawls 14 can be coupled with a second cable system, associated with the drive system for the change carriages, with which the respective change carriage can be moved along the second track 9.

Such a construction of a rack change system makes it possible for

- a first, empty change carriage 6 to be standing on the switch 10 and a second change carriage 7, loaded with at least one roller rack to be fed into the rolling block 1, to be standing on the first track 8;
- a roller rack 2 to be moved from the rolling block 1 onto the first change carriage 6;
- the first change carriage 6 to be moved onto the second track 9, and the second change carriage 7 to be moved from the first track 8 onto the switch 10 and the new roller rack to be moved from the second change carriage 7 into the rolling block 1.

Figure 2:
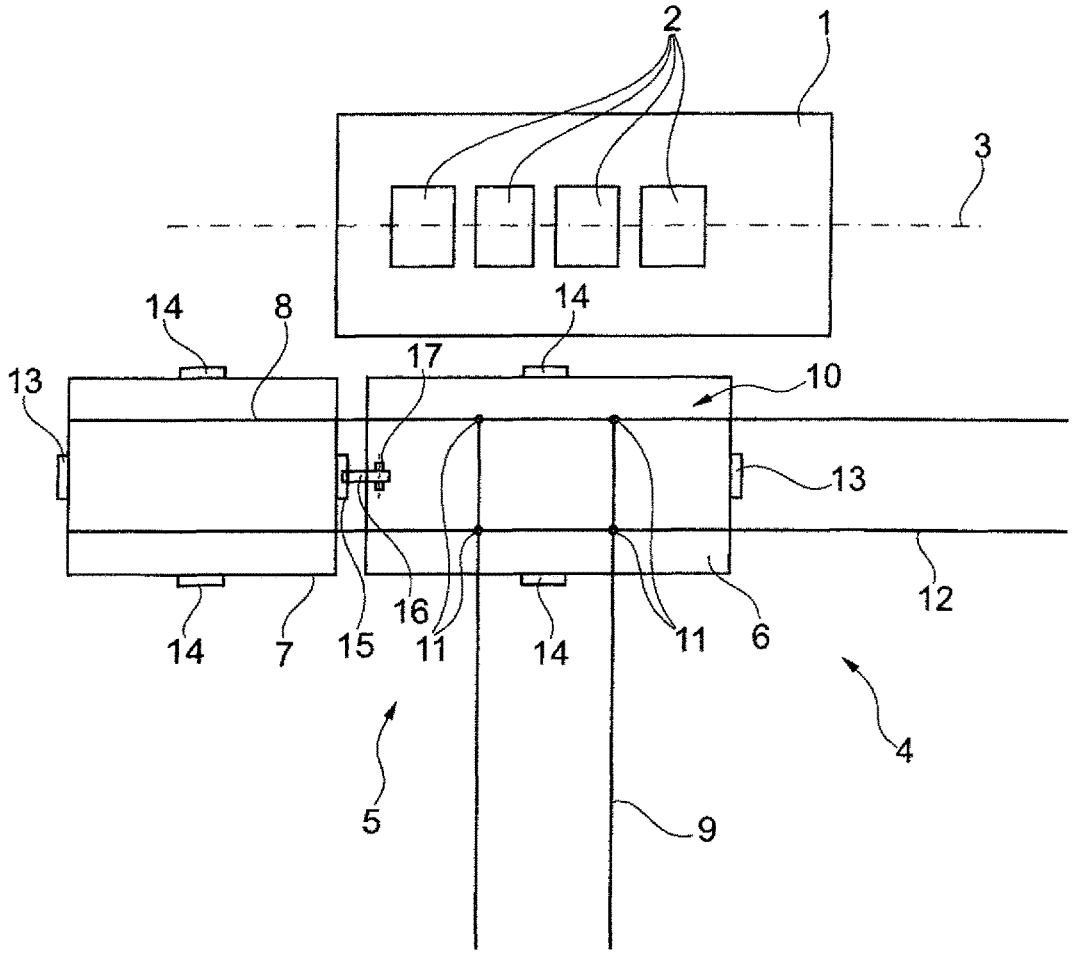
FIG. 2 shows a schematic top view of parts of a second embodiment of a rolling mill according to the invention.

The embodiment shown in FIG. 2 differs from the embodiment shown in FIG. 1 in that a third track 12 is provided, which extends in a direction different from the second track 9 and is connected with the first track 8 and the second track 9 via the switch 10. Like components in the embodiments shown in FIG. 1 and FIG. 2 are denoted by the same reference numerals.

The third track 12 is arranged in alignment with the first track 8 and arranged on the opposite side of the switch 10 with respect to the first track 8. As apparent from FIG. 2, the total length of the first track 8, the switch 10, and the third track 12, corresponds to at least the length of three change carriages.

Such a construction of a rack change system makes it possible for

- a first, empty change carriage 6 to be standing on the switch 10 and a second change carriage 7, loaded with at least one roller rack to be fed into the rolling block 1, to be standing on the first track 8;
- a roller rack 2 to be moved from the rolling block 1 onto the first change carriage 6;
- the first change carriage 6 to be moved onto the third track 12, and
- the second change carriage 7 to be moved from the first track 8 onto the switch 10 and the new roller rack to be moved from the second change carriage 7 into the rolling block 1.

In the embodiment shown in FIG. 2, the change carriage 6 includes a hollow pawl 13 on the side opposite the coupling, while the change carriage 7 includes a hollow pawl 13 on the side opposite the coupling. By coupling the change carriage 6 with the change carriage 7, the coupled change carriages 6, 7 can be moved in the direction of the first track 8 or in the direction of the third track 12 by a cable system, not shown. In the embodiment shown in FIG. 2, both, the change carriage 6 and the change carriage 7, include laterally arranged hollow pawls 14 to move the respective change carriage along the second track 9.

In the embodiment shown in FIG. 2, the change carriage 7 includes a receiving element 15 for a coupling hook 16 of the change carriage 6. The coupling hook 16 is pivotally connected with the change carriage 6 via a hinge 17. The change carriage 7 includes an insertion recess 18, opening into the receiving element 15. Similarly, the change carriage 7 includes an insertion recess 19, corresponding to the insertion recess 18, which is mirrored, however, with respect to the longitudinal axis of the change carriage 7. Through the insertion recesses 18, 19, the coupling hook 16 can be inserted into the receiving element 15 in the insertion direction A or B, respectively. Adjacent to the receiving element 15, a stop 20 for transferring longitudinal forces from the stop 20 to the coupling hook 16 or for transferring longitudinal forces from the coupling hook 16 to the stop 20 is provided. The stop surface of the stop 20 has a surface normal, which is at an angle of 90° to the insertion direction A or B.

Figure 4:
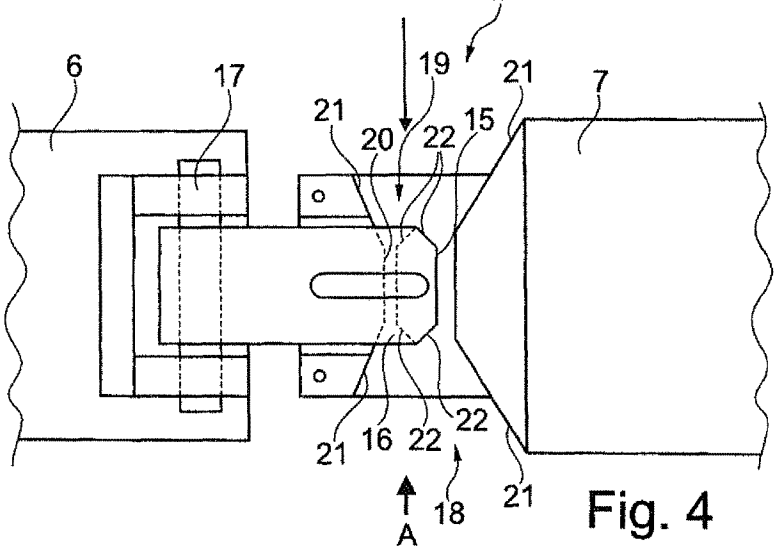
FIG. 4 shows a schematic representation of a top view of the arrangement according to FIG. 3.
Figure 5:
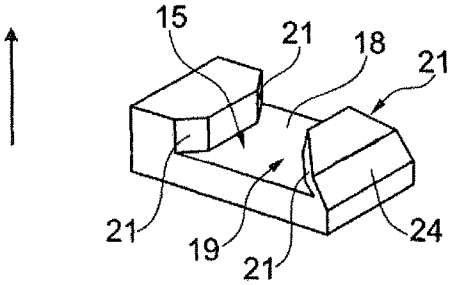
FIG. 5 shows a perspective, schematic view of a receiving element for a coupling hook of a change carriage according to the invention.

As shown in the top view of FIG. 4 and FIG. 5, each insertion recess 18, 19 includes lateral walls, extending at an angle, which, due to their angled arrangement, form threading slopes 21. The threading slopes 21 allow the coupling hook 16 to be easily inserted through the insertion recess 18 or 19 into the receiving element 15, even if the coupling hook 16 and the receiving element 15 are not perfectly aligned. To support the lateral threading slopes 21, the coupling hook 16 includes outwardly tapered threading slopes 22 on its sides facing the direction of insertion.

Figure 3:
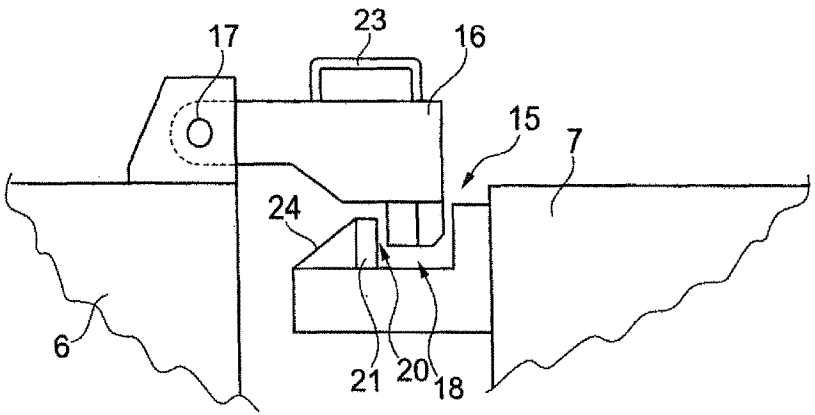
FIG. 3 shows a schematic side view of a receiving element provided on the change carriage according to the invention for a coupling hook as well as a coupling hook of another change carriage held in the receiving element.

As shown in FIGS. 3 and 4, the coupling hook also includes a handle 23, which facilitates pivoting the coupling hook 16 around the hinge 17.

The change carriage 7 further includes a frontally arranged insertion ramp 24, via which the coupling hooks 16 can be inserted into the receiving element 15, wherein the stop surface is adjacent to the surface of the insertion ramp 24. The insertion ramp 24 is used in particular when the change carriage 6 and the change carriage 7 are pushed towards each other along their longitudinal axis in order to be coupled together.

Figure 6:
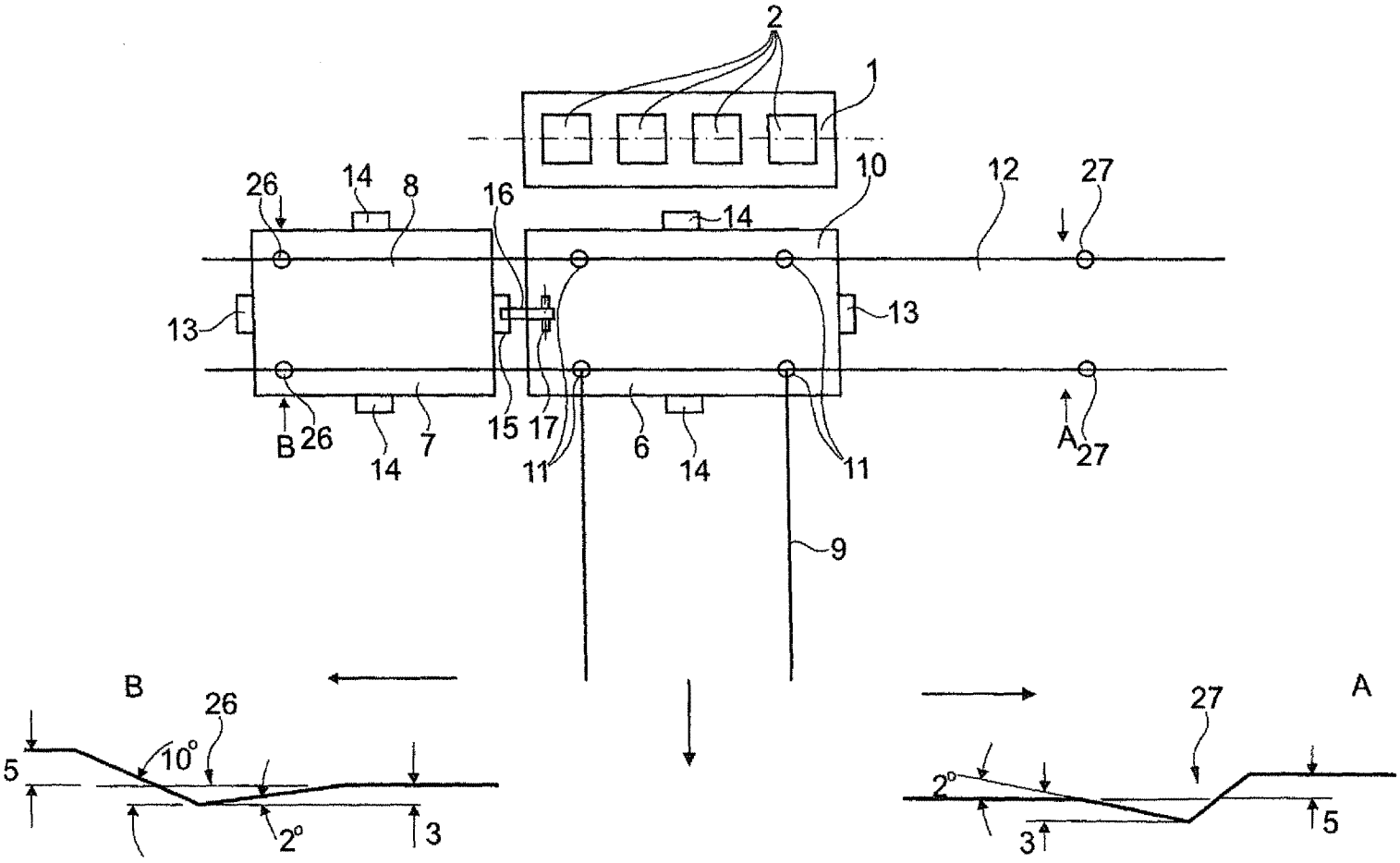
FIG. 6 shows a schematic representation of a top view of the rolling mill according to the invention with inserted schematic side views of the recesses for receiving a wheel set of a change carriage provided in the rails of the tracks.

As shown in FIG. 6, the first track 8 includes two recesses 26 in its area distant from the switch 10. The third track 12 also includes recesses 27 for receiving a wheel set of a change carriage in the area of its rails, distant from the switch 10. The recesses 26 and 27 are arranged at the point at which the respective wheel set is located when a change carriage is standing on the first track 8 or the third track 12 in the desired position for the respective operating situation. As shown in the detailed view A and B, the respective recess 26, 27 respectively includes a ramp in the direction of the switch 10 with a lower ramp angle, for example, 2°, while in the direction facing away from the switch 10, it includes a ramp with a steeper ramp angle, for example an angle of 10°. The flat area, facing the switch 10, ensures that the wheel set rolls easily into the respective recess 26 and 27 and the respective change carriage is held in the respective position by the engagement of the wheel set in the recess, while, for example, another change carriage, coupled to it, is released. On the other hand, the flat ramp angle ensures that the respective change carriage can be pulled out from the recess in the direction of the switch 10 without applying excessive longitudinal forces. In contrast, the respective steeper ramp angle, distant from the switch 10, prevents the change carriage from rolling past the recess and away from the switch 10.

Figure 7A:
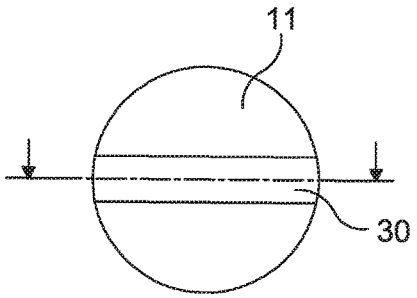
FIGS. 7*a* and *b* shows a rotating body of a switch of a rack change system according to the invention with a track extending over the rotating body in a schematic top view (FIG. 7*a*) and a schematic, partially cut-away perspective view, and FIGS. 8*a* and *b* shows the rotating body of a switch according to the invention with two tracks intersecting at an angle of 90° in a schematic top view (FIG. 8*a*) and a schematic, partially cut-away perspective view (FIG. 8*b*).
Figure 7B:
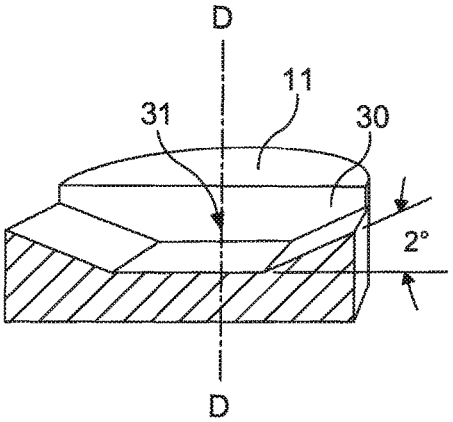
Figure 8B:
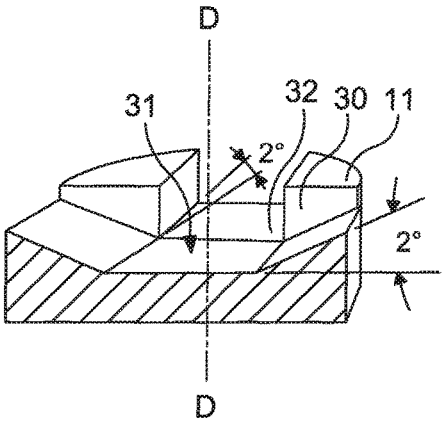

FIGS. 7*a, b* show a rotating body, as used in a rack change system according to the invention, particularly preferably as used in the rack change system according to the invention described with reference to FIGS. 2 and 6. The rotary body 11 includes a track 30, extending straight from one edge of the rotary body 11 to the opposite edge of the rotary body 11. As is apparent from the FIG. 7*b*, the track 30 is formed trough-shaped and, in the center of the rotary body 11, includes a trough 31, on which the track slopes upward at an angle of 2° to the edges of the rotating body 11. The trough holds the wheel set of the change carriage that entered into the switch securely in place, even during pivoting of the rotating body 11 around the rotation axis D. At the same time, the slopes are selected such that a passage through the switch or a rolling down of the change carriage from the switch after rotation of the rotary body 11 can be executed without excessive force.

Figure 8A:
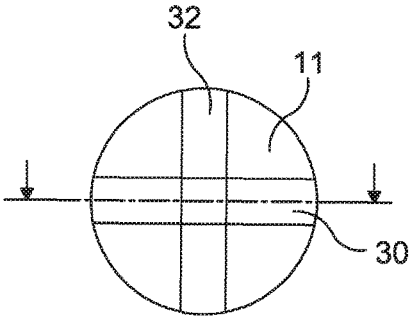

FIGS. 8*a* and *b* show a rotary body 11 of a switch according to the invention. Compared to the rotary body 11 shown in FIGS. 7*a, b*, it is apparent that the rotary body 11 of the switch according to the invention includes a first track 30 and a second track 32. The two tracks 30, 32 intersect at an angle of 90°. As is particularly apparent from FIG. B, the second lane 32 is also trough-shaped. The base of the trough is formed overlapping with the base of the trough 31. The track 32 is also formed with an upward slope to the edges of the rotary body 11 at an angle of 2°. The switch according to the invention can particularly preferably used in connection with the rack change system according to the invention described in more detail in FIG. 1. If at that point the change carriage 6, after receiving the roller racks 2 via the second track 9, is moved to the rack change workshop, then immediately after the switch 10 is cleared, the change carriage 7 can move onto the switch 10 without the rotating body 11 of the switch 10 having to be pivoted for receiving the change carriage 7. The change carriage 7 with its wheel sets simply moves into the respective track of each rotating body 11 that intersects with the respective track that the wheel sets of the change carriage 6 has left.

The invention claimed:

1. A rack change system for changing roller racks of a rolling block comprising a rail system for a change carriage, wherein the rail system includes at least a first track and a second track extending in different directions and connected to one another via a switch, wherein the first track extends parallel to a rolling line of the rolling block, wherein a roller rack is configured for movement from the rolling block onto the change carriage, or from the change carriage into the rolling block, when the change carriage is positioned on the first track and/or on the switch.

2. The rack change system according to claim 1, wherein a third track of the rail system extends at least in one direction different from the direction of the second track and is connected to the first track and/or the second track via a switch.

3. The rack change system according to claim 2, wherein the third track is aligned with the first track and is arranged on the opposite side of the switch with respect to the first track.

4. The rack change system according to claim 2, wherein the total length of the first track, the switch, and the third track corresponds to at least the length of three change carriages.

5. The rack change system according to claim 1, wherein the switch is a rotary switch with a number of rotary bodies that corresponds to the number of wheel sets of the change carriage, wherein one rotary body can accommodate one wheel set of a change carriage and the wheel set, rotatably mounted to the change carriage, is pivotable from a first orientation direction to a second orientation direction by rotation of the rotary body.

6. The rack change system according to claim 1, wherein a drive system for the change carriage is configured to move the change carriage along the first track and, independently thereof, move the change carriage along the second track.

7. The rack change system according to claim 6, wherein the drive system includes two independent cable systems, wherein the change carriage is movable along the first track by the first cable system and, independently thereof, the change carriage is movable along the second track by the second cable system.

8. The rack change system according to claim 1, wherein at least one recess is provided in a rail of one of the tracks for accommodating a wheel set of a change carriage.

9. The rack change system according to claim 1, wherein the change carriage includes locking elements in order to be locked in its position in front of the rolling block and for receiving the roller racks.

10. The rack change system according to claim 1, wherein the change carriage includes a receiving element for a coupling hook of another change carriage and an insertion recess opening into the receiving element, through which a coupling hook can be inserted along an insertion direction into the receiving element, and a stop adjacent to the receiving element for transferring longitudinal forces from the stop to the coupling hook and/or transferring longitudinal forces from the coupling hook to the stop, the stop comprising a stop surface having a surface normal at an angle to the insertion direction.

11. The rack change system according to claim 10, further comprising an insertion ramp, via which a coupling hook can be inserted into the receiving element, wherein the stop surface is adjacent to a surface of the insertion ramp.

12. A method for changing roller racks of a rolling block by means of a roller rack change system, comprising a rail system for one or more change carriages with at least a first track and a second track, each extending in different directions and being connected via a switch, wherein the first track extends parallel to a rolling line of the rolling block, comprising:

positioning a first, empty change carriage on the switch, and a second change carriage, loaded with at least one roller rack to be fed into the rolling block, on the first track;

moving via the rail system a roller rack from the rolling block onto the first change carriage;

moving via the rail system the first change carriage onto the second track;

moving via the rail system the second change carriage from the first track onto the switch, and a new roller rack from the second change carriage into the rolling block.

13. The method according to claim 12, wherein the first change carriage is moved into a roller workshop along the second track.

14. A method for changing roller racks of a rolling block by means of a roller rack change system, comprising a rail system for one or more change carriages with a first track, a second track, and a third track, each extending in different directions and being connected via a switch, wherein the first track extends parallel to a rolling line of the rolling block, comprising:

positioning a first, empty change carriage on the switch and a second change carriage, loaded with at least one roller rack to be fed into the rolling block, on the first track;

moving via the rail system a roller rack from the rolling block onto the first change carriage;

moving via the rail system the first change carriage onto the third track; moving via the rail system the second change carriage from the first track onto the switch and a new roller rack from the second change carriage into the rolling block.

15. The method according to claim 14, wherein the second change carriage, after transferring the new roller rack to the rolling block, is moved onto the first track and the first change carriage is moved from the third track onto the switch and then moved from the switch onto the second track and moved to a rack workshop via the second track.

16. The method according to claim 15, wherein, in the roller workshop, the first change carriage is loaded with a new roller rack to be fed into the rolling block and is moved along the second track onto the switch and from the switch onto the third track.

17. The method according to claim 16, wherein, with the movement of the first change carriage from the switch onto the third track, the second change carriage is moved from the first track onto the switch.

* * * * *